US007918068B2

(12) United States Patent
Kumano

(10) Patent No.: US 7,918,068 B2
(45) Date of Patent: Apr. 5, 2011

(54) TABLET FILLING INSTRUMENT

(75) Inventor: Yoshinori Kumano, Osaka (JP)

(73) Assignee: Yuyama Mfg. Co., Ltd. (JP)

( * ) Notice: Subject to any disclaimer, the term of this patent is extended or adjusted under 35 U.S.C. 154(b) by 102 days.

(21) Appl. No.: 12/227,915

(22) PCT Filed: Jun. 18, 2008

(86) PCT No.: PCT/JP2008/061161

§ 371 (c)(1),
(2), (4) Date: Dec. 2, 2008

(87) PCT Pub. No.: WO2008/156122

PCT Pub. Date: Dec. 24, 2008

(65) Prior Publication Data

US 2010/0229506 A1 Sep. 16, 2010

(30) Foreign Application Priority Data

Jun. 21, 2007 (JP) ..... 2007-164048
Jun. 11, 2008 (JP) ..... 2008-153229

(51) Int. Cl.
*B65B 57/00* (2006.01)

(52) U.S. Cl. ..... 53/52; 53/235; 221/9; 700/216

(58) Field of Classification Search ..... 53/52, 55, 53/493, 495, 235; 221/9; 700/216
See application file for complete search history.

(56) References Cited

U.S. PATENT DOCUMENTS

| | | | | |
|---|---|---|---|---|
| 5,208,762 | A * | 5/1993 | Charhut et al. | 700/216 |
| 6,202,923 | B1 * | 3/2001 | Boyer et al. | 235/375 |
| 2003/0085235 | A1 * | 5/2003 | William et al. | 221/92 |
| 2003/0121929 | A1 * | 7/2003 | Liff et al. | 221/7 |

FOREIGN PATENT DOCUMENTS

| | | |
|---|---|---|
| JP | 03-240603 | 10/1991 |
| JP | 03-264065 | 11/1991 |
| JP | 08-091301 | 4/1996 |
| JP | 2002-366657 | 12/2002 |
| JP | 2004-305721 | 11/2004 |

* cited by examiner

*Primary Examiner* — Stephen F Gerrity
(74) *Attorney, Agent, or Firm* — Wood, Phillips, Katz, Clark & Mortimer

(57) ABSTRACT

A tablet filling instrument 1 for dispensing tablets into a vial 9 in accordance with prescription data and discharging the vial 9 filled with the tablets in one of a plurality of outlets 113 designates at least one of the outlets 113 to be a priority outlet $\mathbf{113}_p$ and discharges the vial 9 filled with the tablets in the priority outlet $\mathbf{113}_p$ when the tablets are to be dispensed in one of the outlets 113 at a time-point within a predetermined time length from a present time-point.

6 Claims, 20 Drawing Sheets

TABLET FILLING INSTRUMENT

TECHNICAL FIELD

The present invention relates to a tablet filling instrument for filling a vial with tablets.

BACKGROUND ART

Prescription drugs generally have an appointed time-point (in the present application, a term "time-point" means "date and time") when the drugs are to be dispensed or delivered to a patient, so that they are prepared to meet the appointed time-point. In a tablet filling instrument which dispenses tablets into a vial in accordance with prescription data and discharges the vial filled with the tablets in an outlet, the vial filled with the tablets is held in the outlet until being taken out by an operator. A vial filled with tablets having a quickly-impending appointed time-point may not be discharged in the outlet if all of a plurality of outlets are occupied by other vials. That forces patients who come for receiving drugs at the appointed time-point into waiting.

Conventionally, the below-identified patent document 1 discloses a dispensing system for reducing the patient's waiting time as a whole by displaying a progress of work of a dispensing instrument in a display to show an operator a status of dispensing operations so as to adjust schedules of the dispensing operations carried out by the instrument. The below-identified patent document 2 discloses an audit information processing system for reducing the patient's waiting time by adding a priority flag to an urgent audit data to be rearranged and ranked higher so as to audit the data by priority.

The systems described in the above-mentioned patent documents may not reduce the patient's waiting time if prepared drugs are not discharged appropriately by the dispensing instruments, even though a schedule or the order of audition is artificially adjusted through displays of a progress of work of the instrument or a degree of urgency of audit data.

Patent Document 1: JP 6-9600 B

Patent Document 2: JP 2002-366657 A

DISCLOSURE OF INVENTION

Problem to be Solved by the Invention

It is therefore an object of the present invention to provide a tablet filling instrument, which is one of dispensing instruments, capable of efficiently discharging vials each filled with tablets in view of priority so as to avoid long waiting time of patients.

Means to Solve the Problem

In order to solve the above-mentioned problems and drawbacks, the present invention provides a tablet filling instrument having a plurality of outlets, for dispensing tablets into a vial in accordance with prescription data and discharging the vial filled with the tablets in one of the outlets, the instrument designating at least one of the outlets to be a priority outlet and the other outlets to be normal outlets, so that a vial filled with tablets that are to be dispensed in one of the outlets at a time-point (i.e., date and time) within a predetermined time length from a present time-point is discharged in the priority outlet.

According to the above-mentioned configuration, a vial filled with tablets to be dispensed at a time-point within a predetermined time length from a present time-point is discharged in the priority outlet, so as to facilitate an immediate takeout of the vial.

The time-point to dispense the tablets is preferably contained in the prescription data. Thereby, at the time of receiving a prescription data, whether a time-point to dispense the tablets is quickly-impending or has plenty of time is determined quickly.

The instrument preferably discharges the vial filled with the tablets in one of the normal outlets in the case that the priority outlet is occupied. In this case, it is preferable to display that a vial having been discharged in the normal outlet has a priority over others.

The instrument preferably indicates a display to urge to take out a vial having been discharged in one of the normal outlets in the case that the normal outlets are also occupied. Looking at this display, an operator takes out the vial from the outlet, and as a consequence, immediately after the takeout, a vial filled with tablets to be dispensed at a quickly-impending time-point is discharged in the outlet, which has become vacant.

ADVANTAGEOUS EFFECT OF THE INVENTION

The present invention designates at least one of a plurality of outlets to be a priority outlet, so that a vial filled with tablets that are to be dispensed in one of the outlets at a time-point within a predetermined time length from a present time-point is discharged in the priority outlet. Thereby, the vial is discharged efficiently in view of priority and an immediate takeout of the vial is facilitated. That avoids forcing patients into waiting for a long period of time.

BEST MODE FOR CARRYING OUT THE INVENTION

Figure 1:
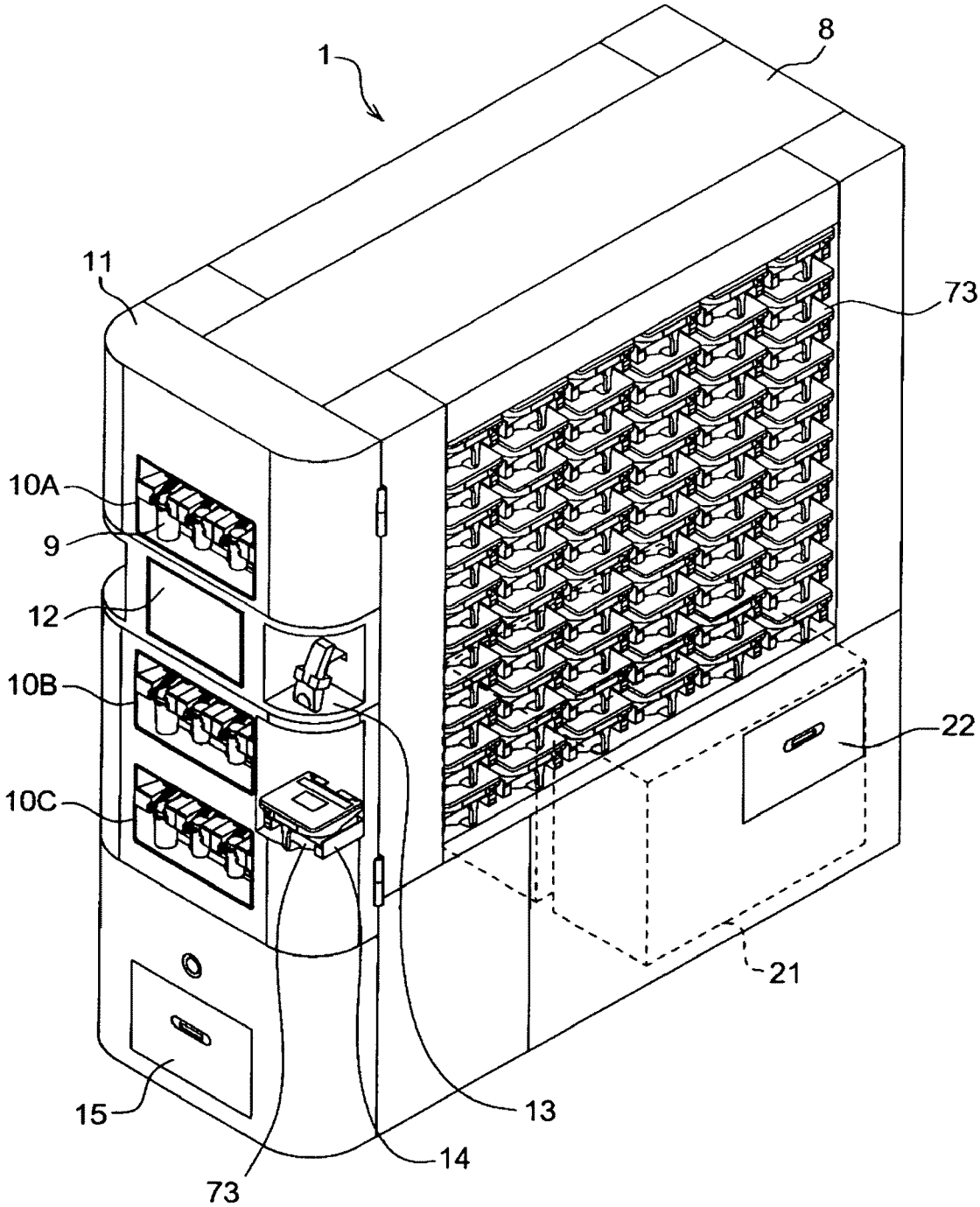
FIG. 1 is a perspective view of a tablet filling instrument of the present invention.
Figure 2:
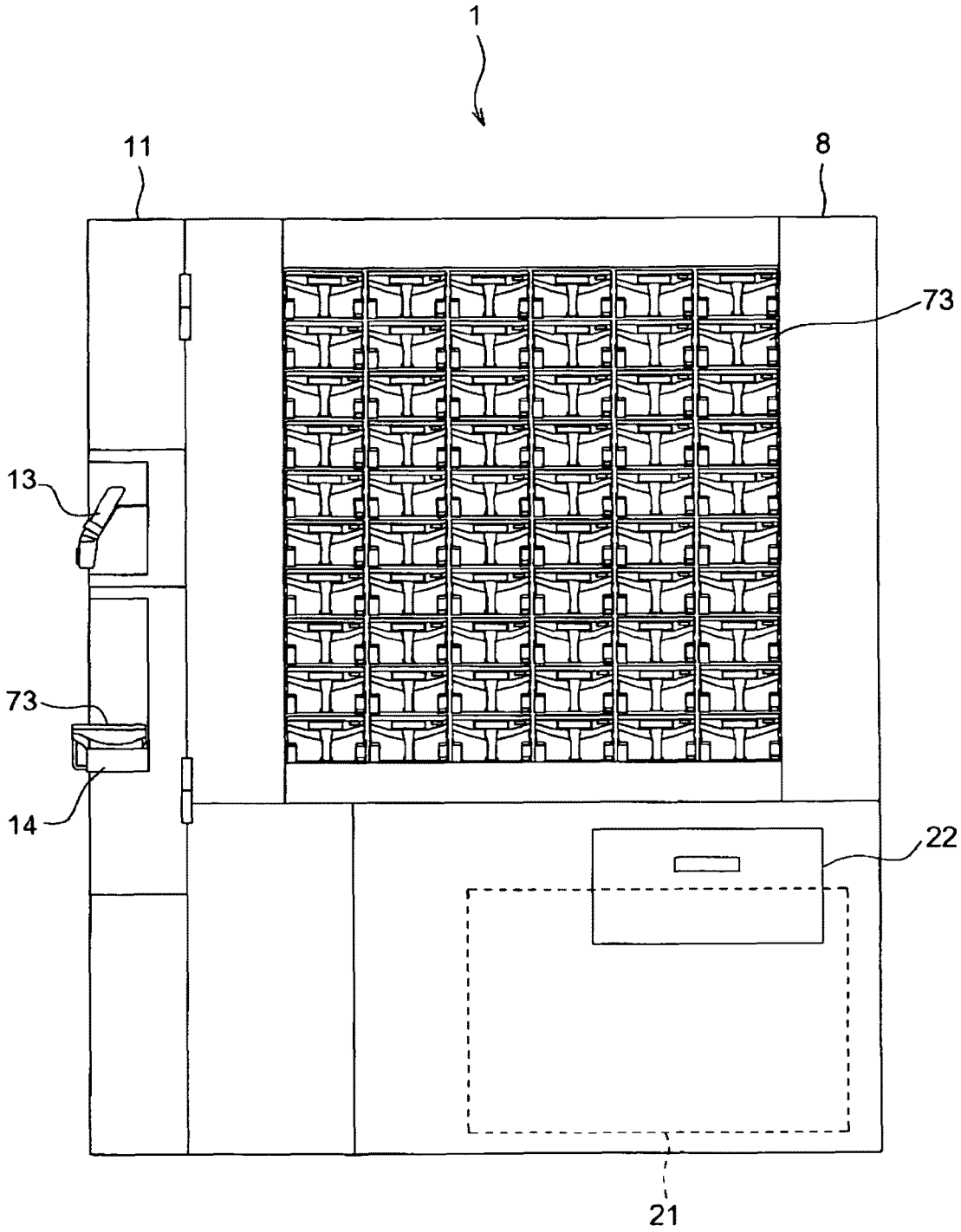
FIG. 2 is a side view of the tablet filling instrument in FIG. 1.
Figure 3:
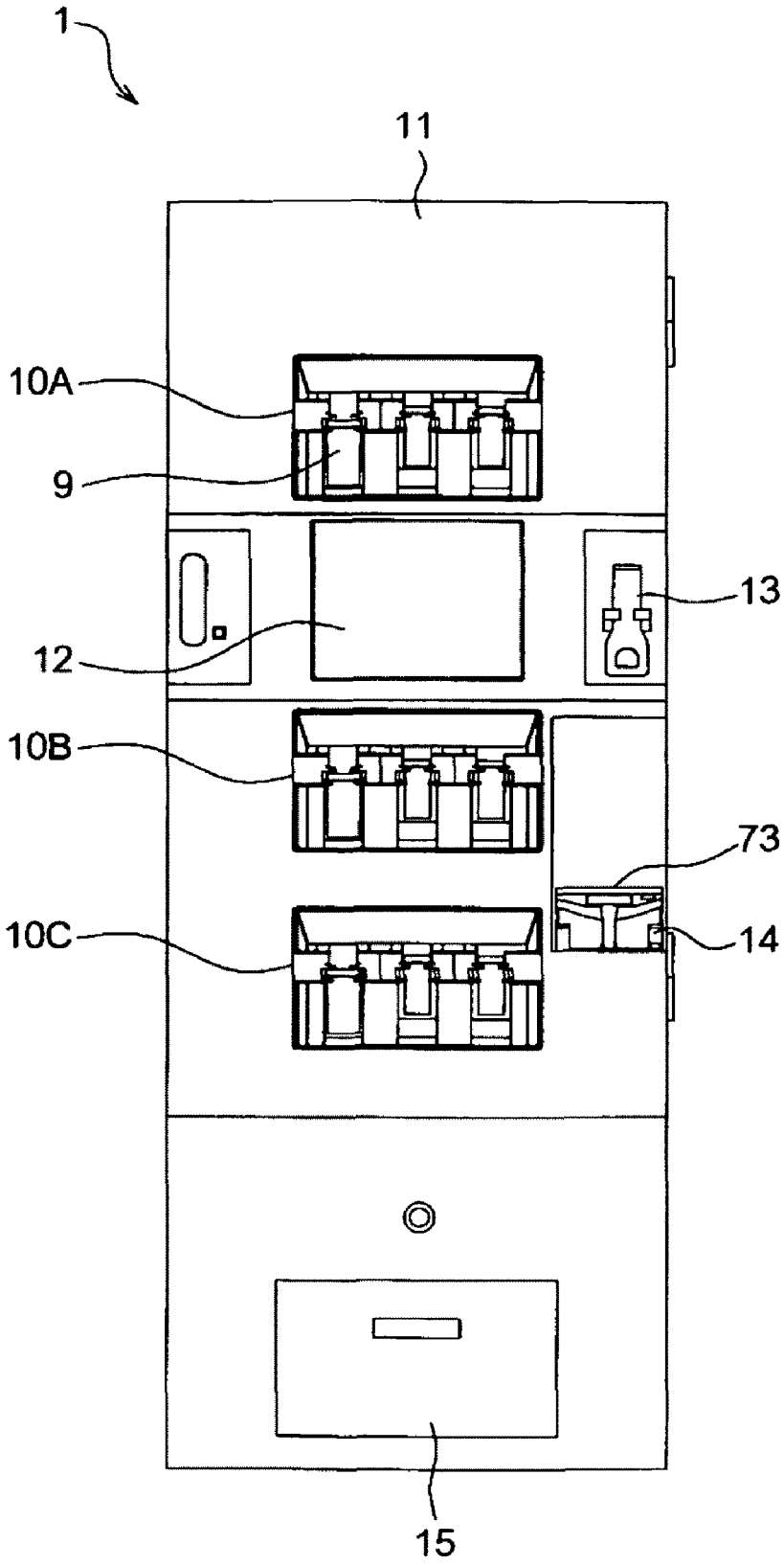
FIG. 3 is a front view of the tablet filling instrument in FIG. 1.
Figure 4:
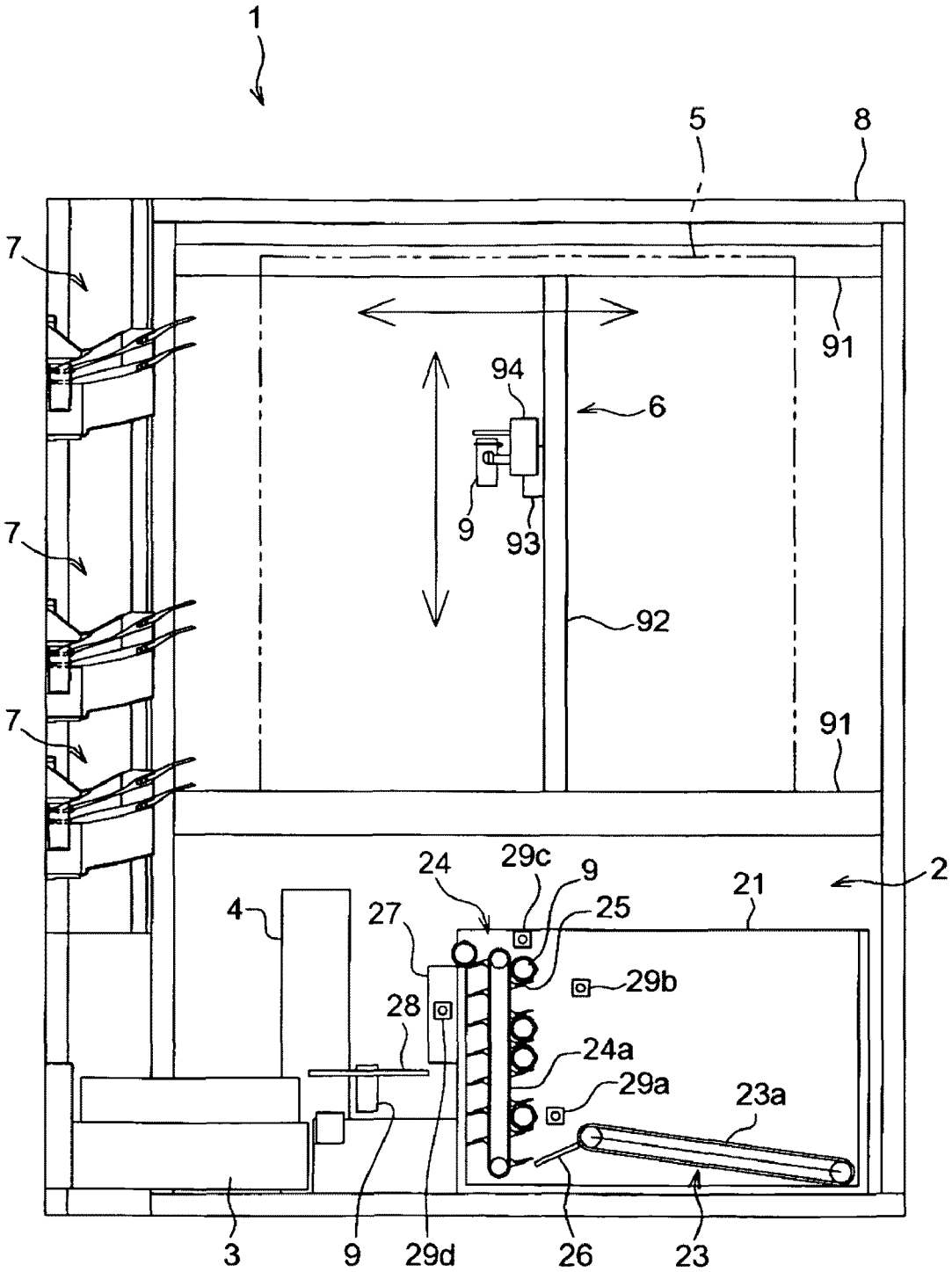
FIG. 4 is a side cross section of the tablet filling instrument in FIG. 1.

FIGS. 1 to 4 show a tablet filling instrument 1 that is an embodiment of the present invention. As shown in FIG. 4, the instrument 1 includes a vial supply unit 2, a labeling unit 3, a vial lifter 4, a tablet supply unit 5, a conveying unit 6, and a discharging unit 7. Herein, the instrument 1 has a main body 8, in which a face provided with discharging windows 10A, 10B and 10C for vials 9 is designated as a front.

The front of the main body 8 has a front door 11 being openable and closable. The front door 11 has an operation panel 12 between the upper discharging window 10A and the middle discharging window 10B besides the three discharging windows 10A, 10B and 10C opening and juxtaposed vertically. There is provided a barcode reader 13 on the right side of the operation panel 12 and an auxiliary mounting table 14 for filling or returning of tablets below the reader 13. There is provided a drawer for pulling out the labeling unit 3 below the lower discharging window 10C.

<Vial Supply Unit 2>

Figure 5:
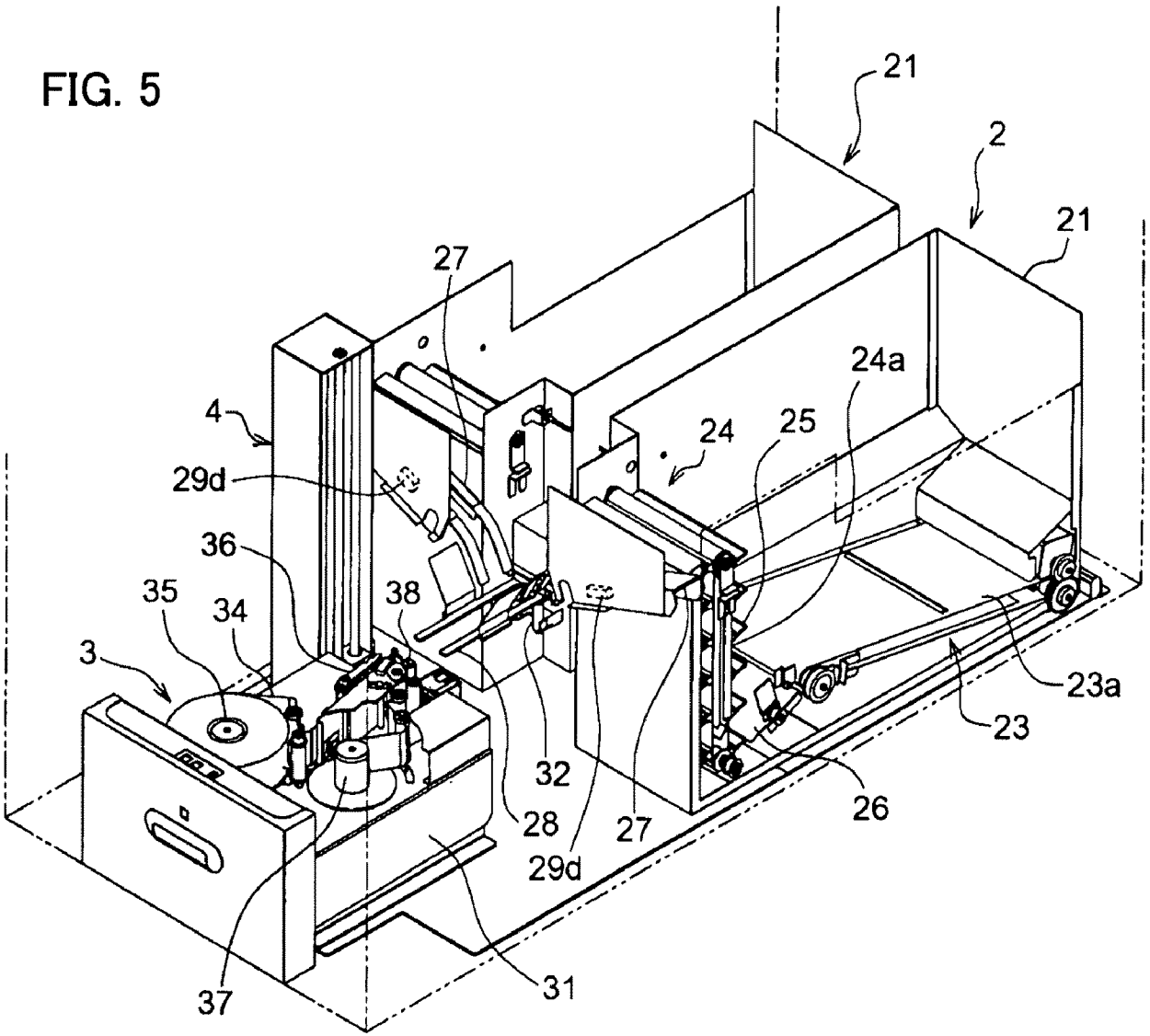
FIG. 5 is a perspective view of a vial supply unit, a labeling unit, and a vial lifter.

As shown in FIG. 5, the vial supply unit 2 has a pair of stockers 21 of a rectangular box shape disposed on both sides at the bottom of the back thereof as viewed from the front of the main body 8. Each stocker 21 randomly stocks vials 9 of various sizes. Vials 9 are to be refilled by opening doors 22 (see FIG. 1) disposed on the right and left sides of the main body 8. Each stocker 21 has on its inside bottom a conveyer 23 composed of an endless belt 23*a* slanting upward toward the front of the main body 8 and capable of being driven to run. The conveyer 23 is designed to convey vials 9 stocked in the stocker 21 toward the front side. Each stocker 21 further has a take-out device 24 disposed vertically along the inner wall of the front of the stocker 21. The take-out device 24 is composed of an endless belt 24*a* capable of being driven to run, to which paddles 25 are attached at regular intervals. A vial 9 is held horizontally by each paddle 25 to be taken out in accordance with ascent of the endless belt 24*a*. There is provided a guide plate 26 between the front end of the conveyer 23 and the lower end of the take-out device 24, for guiding vials 9 having been conveyed by the conveyer 23 to the paddles 25 of the take-out device 24.

Figure 6:
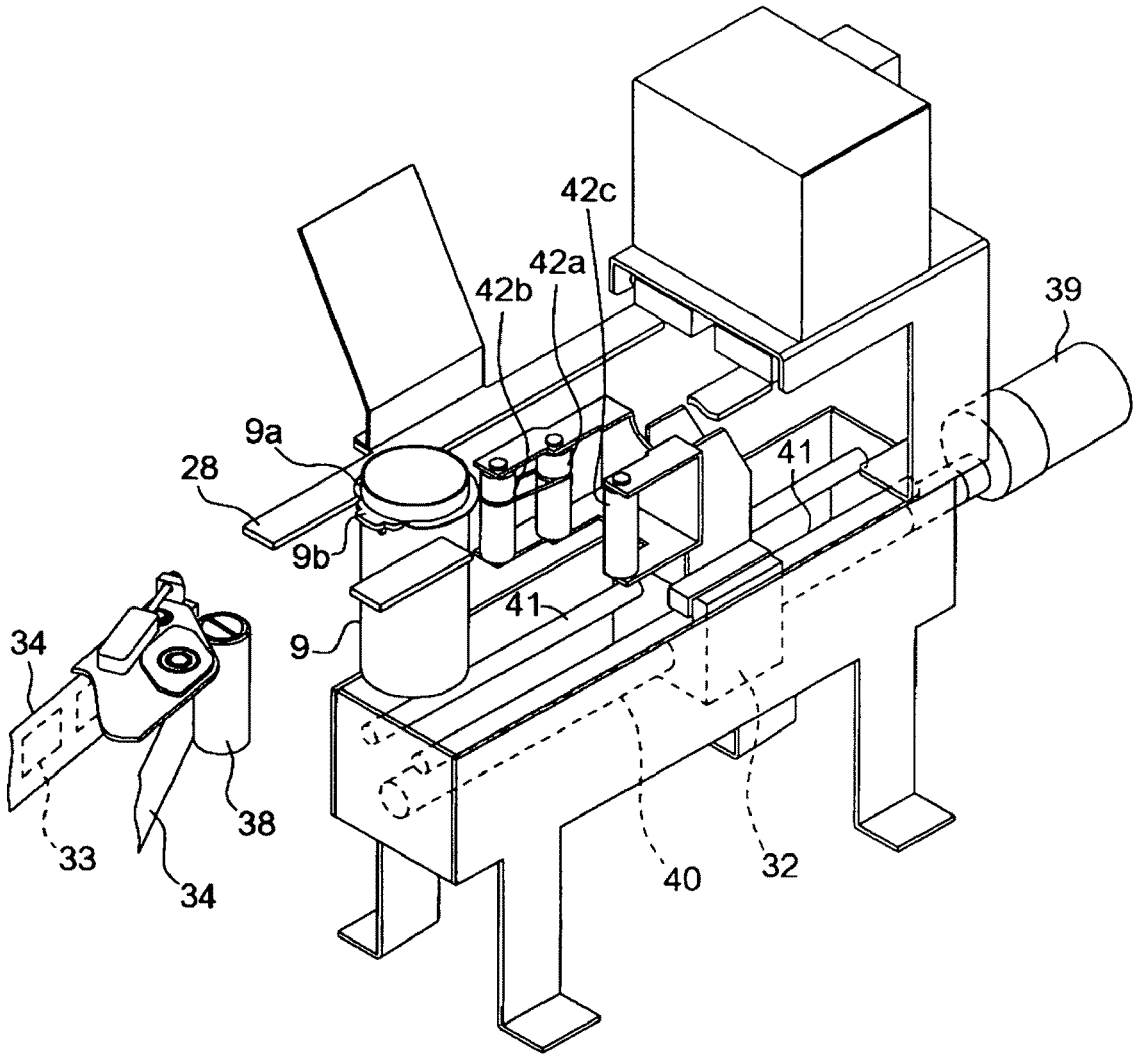
FIG. 6 is a perspective view of the labeling unit.

The stockers 21 have on the outer walls of the front sides a pair of chutes 27 for sliding vials 9 having been taken out from the stockers 21 by means of the take-out devices 24 and a pair of forks 28 for receiving and holding the vials 9 having been slid from the pair of chutes 27. The forks 28 have horizontally variable-width so as to hold any of vials 9 of various sizes by means of the known mechanism such as a rack-and-pinion mechanism. Herein, vials 9 each, as shown in FIG. 6, have a flange 9*a* around an outer periphery of its opening and a protruding piece 9*b* having a mechanism of locking a cap not shown.

The vial supply unit 2, as shown in FIG. 4, has four sensors inside each of the stockers 21: a stockout sensor 29*a* at its lower part; an overfill sensor 29*b* at its upper part; a preparatory state detection sensor 29*c* for detecting a vial 9 held by the paddle 25 in the topmost position; and a vial waiting sensor 29*d* for detecting a vial 9 having been stopped on the chute 27 by a stopper not shown.

<Labeling Unit 3>

As shown in FIG. 5, the labeling unit 3 mainly consists of a label printer 31 and a pusher 32. The label printer 31, as shown in FIG. 6, uses a label tape 34, on which labels 33 to be applied around vials 9 are applied at regular intervals. The label printer 31, as shown in FIG. 5, is the known one, which includes (1) a tape reel 35 around which the label tape 34 is wound, (2) a print head 36 for printing information such as a prescription number, a patient's name, and a drug name on each label 33 of the label tape 36 supplied from the tape reel 35, (3) a take-up reel 37 for taking up the label tape 34 from which the label 33 has been removed, and (4) a driving roller 38 for rotating vials 9. The pusher 32 is, as shown in FIG. 6, movable along a guide rod 41 and parallel to the forks 28 by means of a ball screw 40 driven by a motor 39. The pusher 32 has three rollers 42*a*, 42*b* and 42*c*, by which a vial 9 held by the forks 28 of the vial supply unit 2 is pressed against the driving roller 38 of the label printer 31. The main body 32, as shown in FIG. 8, has a sensor 43 for detecting a position of the protruding piece 9*b* of a vial 9 of a large or small size.

<Vial Lifter 4>

Figure 7:
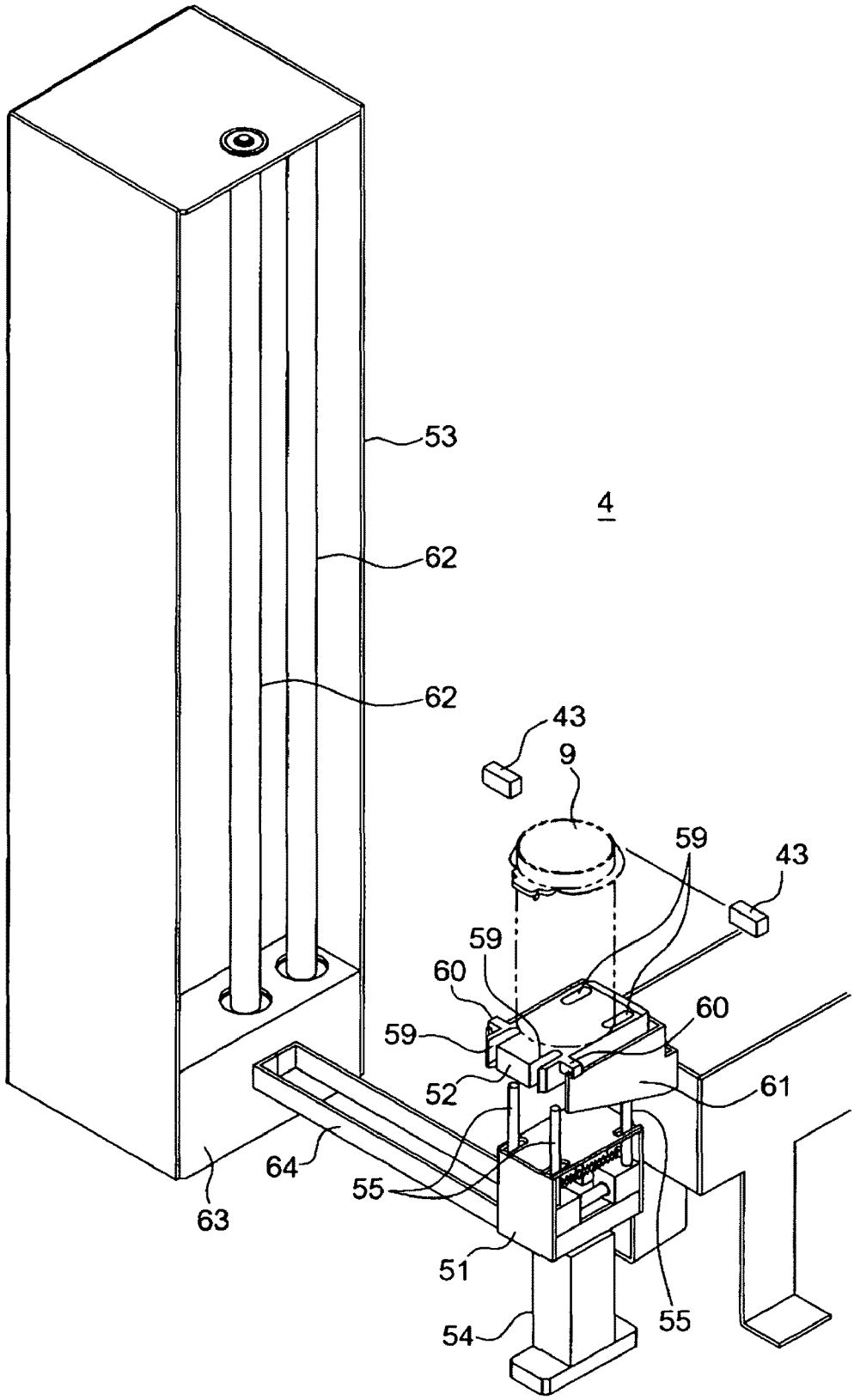
FIG. 7 is a perspective view of the vial lifter in which a lifting table is in a wait status.
Figure 8:
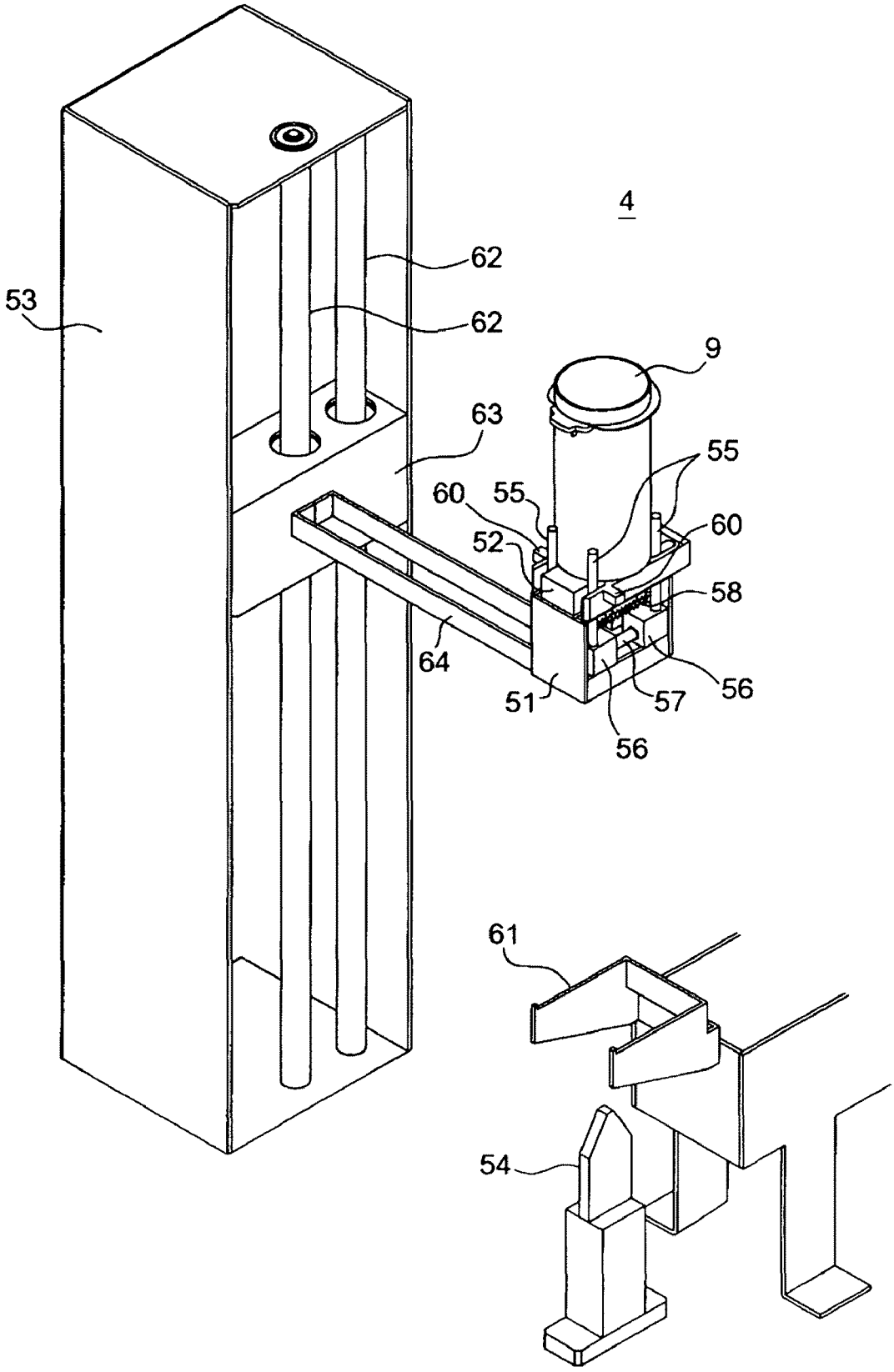
FIG. 8 is a perspective view of the vial lifter in which the lifting table is moving up.
Figure 9A:
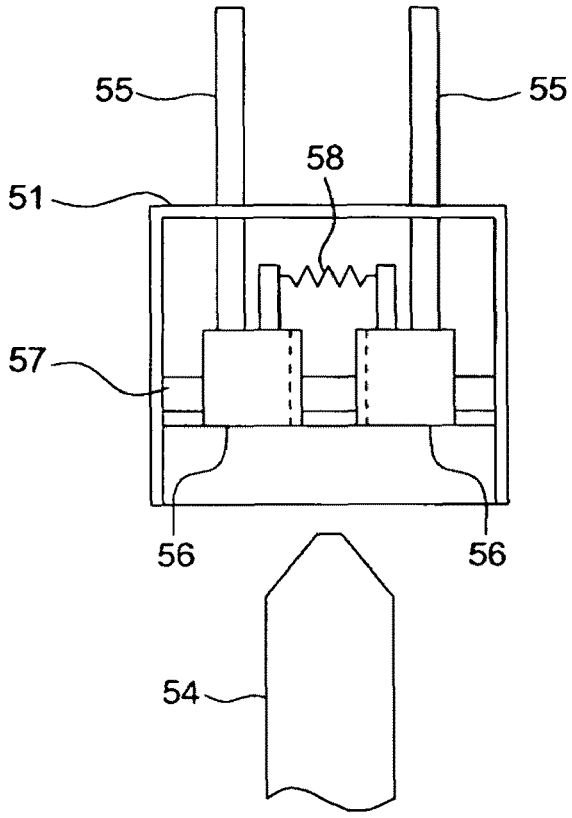
FIGS. 9A and 9B are side views showing operations of movable blocks of pins and a bar for opening and closing pins.
Figure 9B:
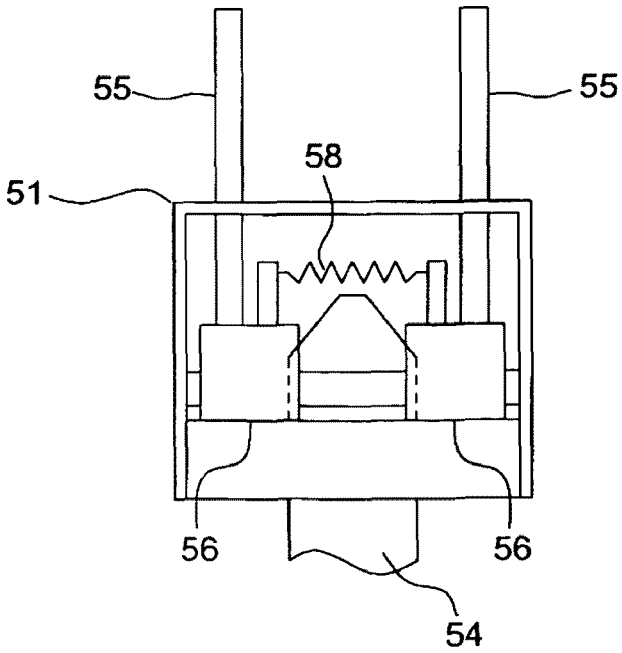
Figure 10:
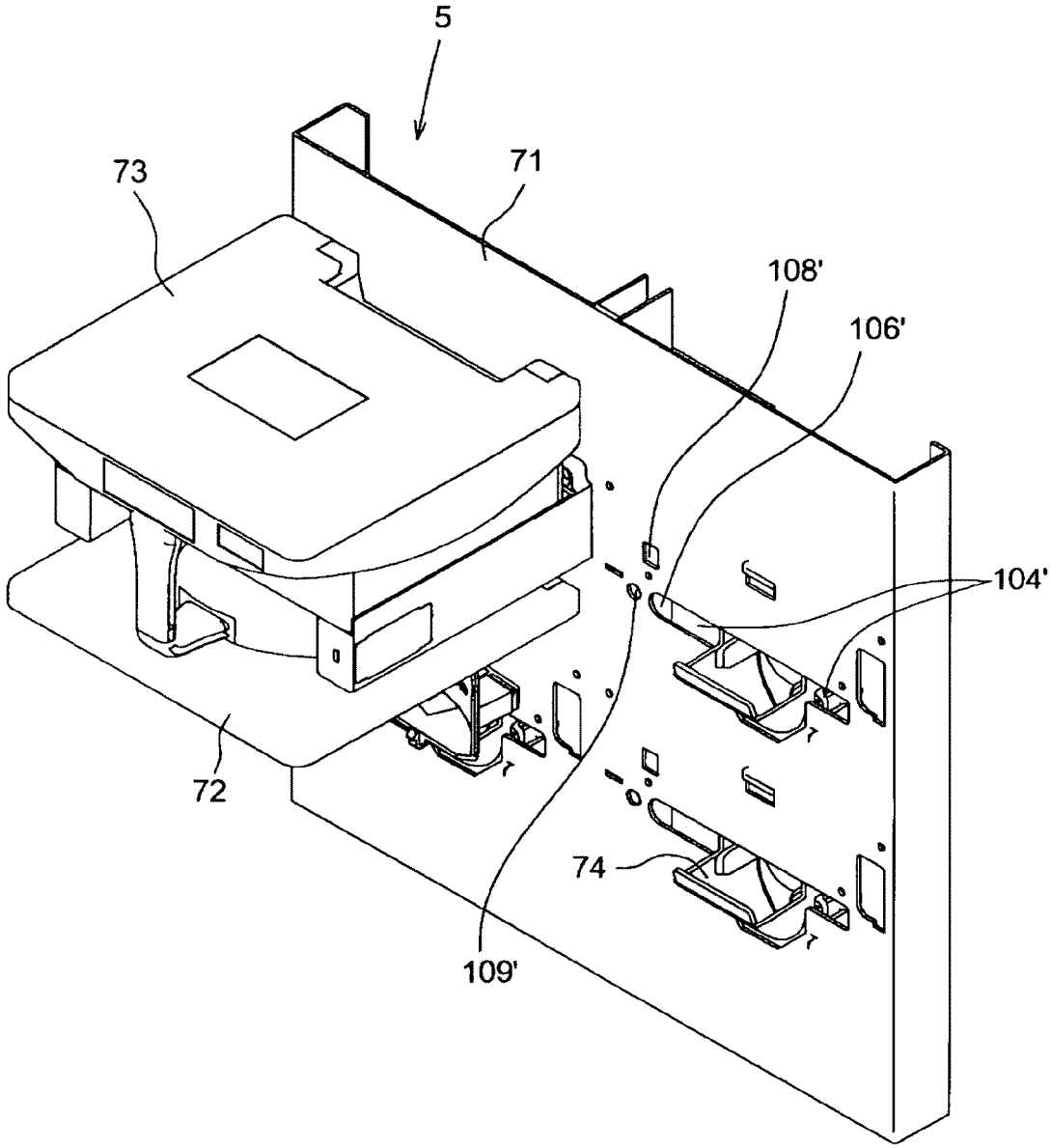
FIG. 10 is a perspective view of a tablet supply unit.

As shown in FIGS. 7 to 9, the vial lifter 4 mainly consists of a lifting to table 51 on which a vial 9 is placed, a holding plate 52 mounted on the lifting table 51, a lifting mechanism 53 for lifting and lowering the lifting table 51 and the holding plate 52, and a bar 54 for opening and closing pins.

The lifting table 51 has on its top face four pins 55 sticking up and for holding an outer periphery of a vial 9. There is provided two movable blocks 56, to each block 56 bases of a pair of the opposed pins 55 are fixed. The two movable blocks 56 are movable in directions toward and away from each other along guide rods 57 and are urged in a direction toward each other by springs 58. The holding plate 52 has elongated cutouts 59 in which the four pins 55 are inserted. The holding plate 52 has at its outer periphery a plurality of lugs 60 and is designed to be put on a bracket 61 fixed to the main body 8 with the lugs 60. The lifting mechanism 53 has a lifting block 63 lifting and lowering along guide rods 62 by means of a belt driving device not shown, the lifting block 63 having an arm 64 so as to fix the lifting table 51 to a distal end of the arm 64. The bar 54 for opening and closing pins is located below the lifting table 51 and is fixed to the main body 8. The bar 54 is engaged with and disengaged from a space between the two movable blocks 56 of the lifting table 51 in accordance with lifting and lowering movements of the lifting table 51 so as to move the movable blocks 56 to open and close the four pins 55.

When the lifting plate 51 is lowered by driving of the lifting mechanism 53 of the vial lifter 4, as shown in FIG. 7, the four pins 55 are extended by the bar 54 located below the lifting table 51 and each move in a direction away from the vial 9 against the urging force of the springs 58. The holding plate 52 stops on the way down of the lifting table 51 by being hung up by the bracket 61, meanwhile the lifting table 51 continues down to the bottommost position. When the lifting table 51 moves up from the bottommost position, as shown in FIG. 8, the holding plate 52 hung up by the bracket 61 is placed on the table 51. Meanwhile, the four pins 55 are disengaged from the bar 54, thereby pressing and holding the vial 9 placed on the holding plate 52 by the urging force of the springs 58. The lifting mechanism 53 conveys the vial 9 placed on the lifting table 51 from a labeling position to a delivery position of the conveying unit 6 described below.

<Tablet Supply Unit 5>

Figure 11:
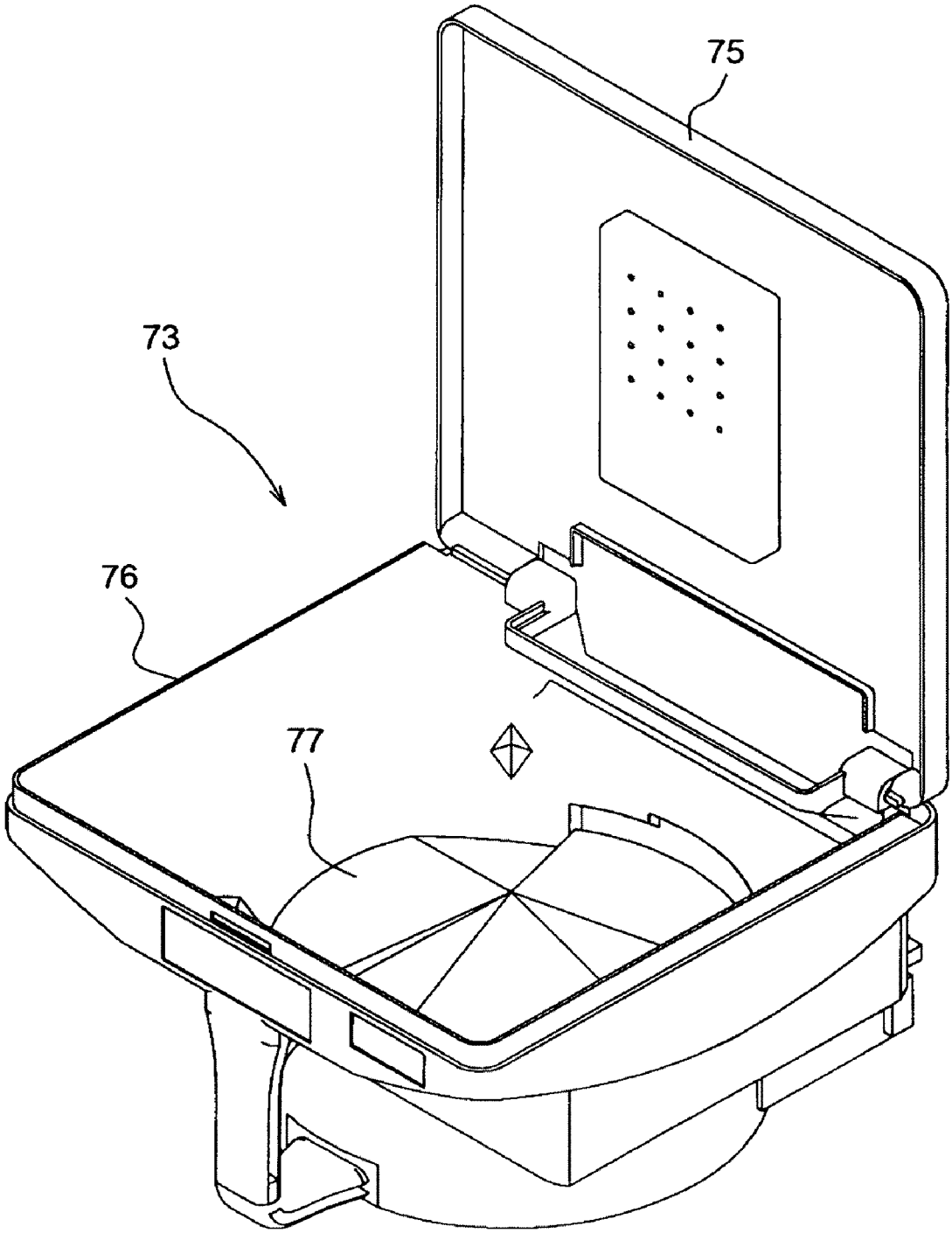
FIG. 11 is a perspective view of a tablet cassette viewed from above.
Figure 12:
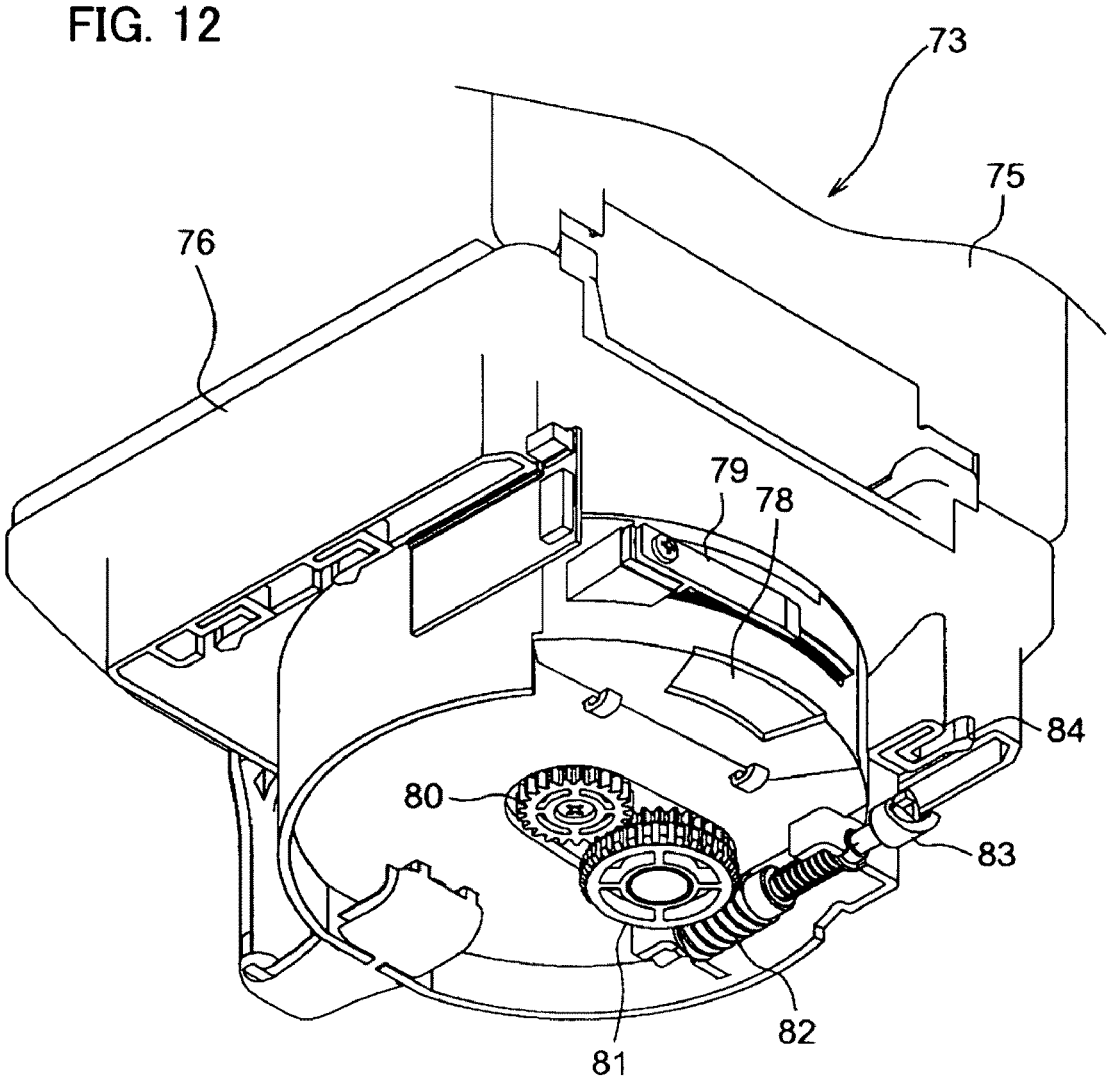
FIG. 12 is a perspective view of the tablet cassette viewed from below.

The tablet supply unit 5 includes supporting panels 71 at both sides of the main body 8, attaching boards 72 disposed on the panels 71, and a number of tablet cassettes 73 detachably attached on the boards 72. Each supporting panel 71 has tablet outlets 74 formed at positions corresponding to the tablet cassettes 73 respectively, and further has sensor holes 104', driving shaft holes 106', protruding piece holes 108', and detection rod holes 109' in which count sensors 104, driving shafts 106, protruding pieces 108, and detecting rods 109 of an arm unit 94 described below are put respectively. Each tablet cassette 73, as shown in FIG. 11, mainly consists of a tablet container 76 with a lid 75 attached thereto openably and closably and a rotor 77 attached rotatively to the inner bottom of the container 76. The rotor 77 has pockets (not shown) for holding tablets at its outer periphery, which extend in an axial direction and are juxtaposed at regular intervals in a peripheral direction. The tablet container 76, as shown in FIG. 12, has an outlet 78 formed at its outside bottom and communicating with one of the pockets of the rotor 77. There is provided a partition 79 attached above the outlet 78, for partitioning the pocket of the rotor 77 and for discharging a bottommost tablet among tablets held in the pocket through the outlet 78. The tablet container 76 has in the center of its outside bottom a rotor gear 80 fixed to a rotating shaft of the rotor 77 penetrating the bottom of the container 76. The tablet container 76 further has an intermediate gear 81 engaging with the rotor gear 80 and a worm gear 82 engaging with the intermediate gear 81, both attached to its outside bottom. The worm gear 82 has an engaging receptacle 83 formed at its end and engaging with an engaging portion 107 of the driving shaft 106 of the conveying unit 6 described below to receive power. The tablet container 76 further has at its back side an engaging portion 84 formed adjacent to the engaging receptacle 83.

<Conveying Unit 6>

As shown in FIG. 4, the conveying unit 6 is disposed between the tablet supply units 5 at both sides of the main body 8 and includes first horizontal rails 91 fixed to the top and bottom of the main body 8, a vertical rail 92 mounted on the first horizontal rails 91 movably in an anteroposterior direction, a second horizontal rail 93 mounted on the vertical rail 92 movably in a vertically direction, and the arm unit 94 mounted on the second horizontal rail 93 movably in a lateral direction.

Figure 13:
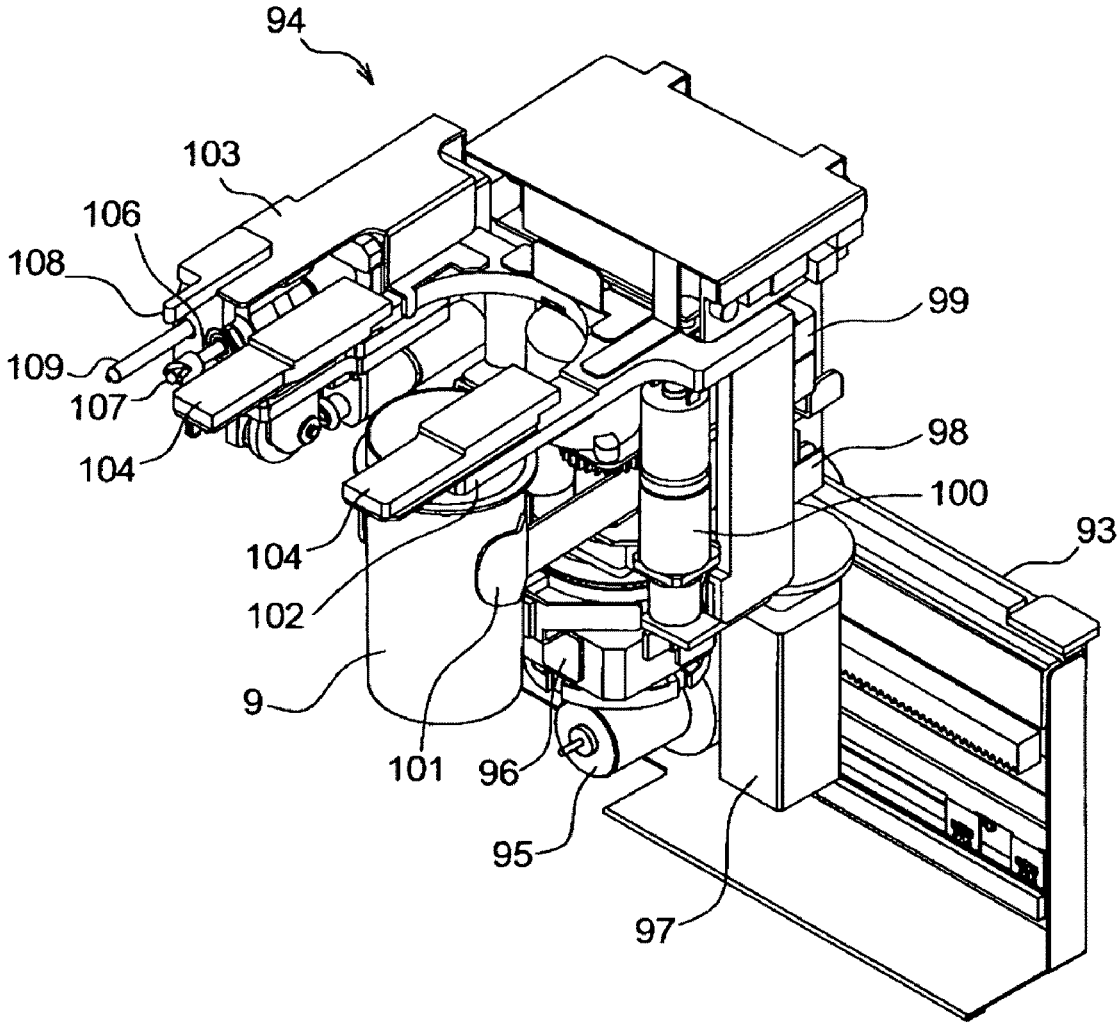
FIG. 13 is a perspective view of an arm unit of a conveying unit.
Figure 14:
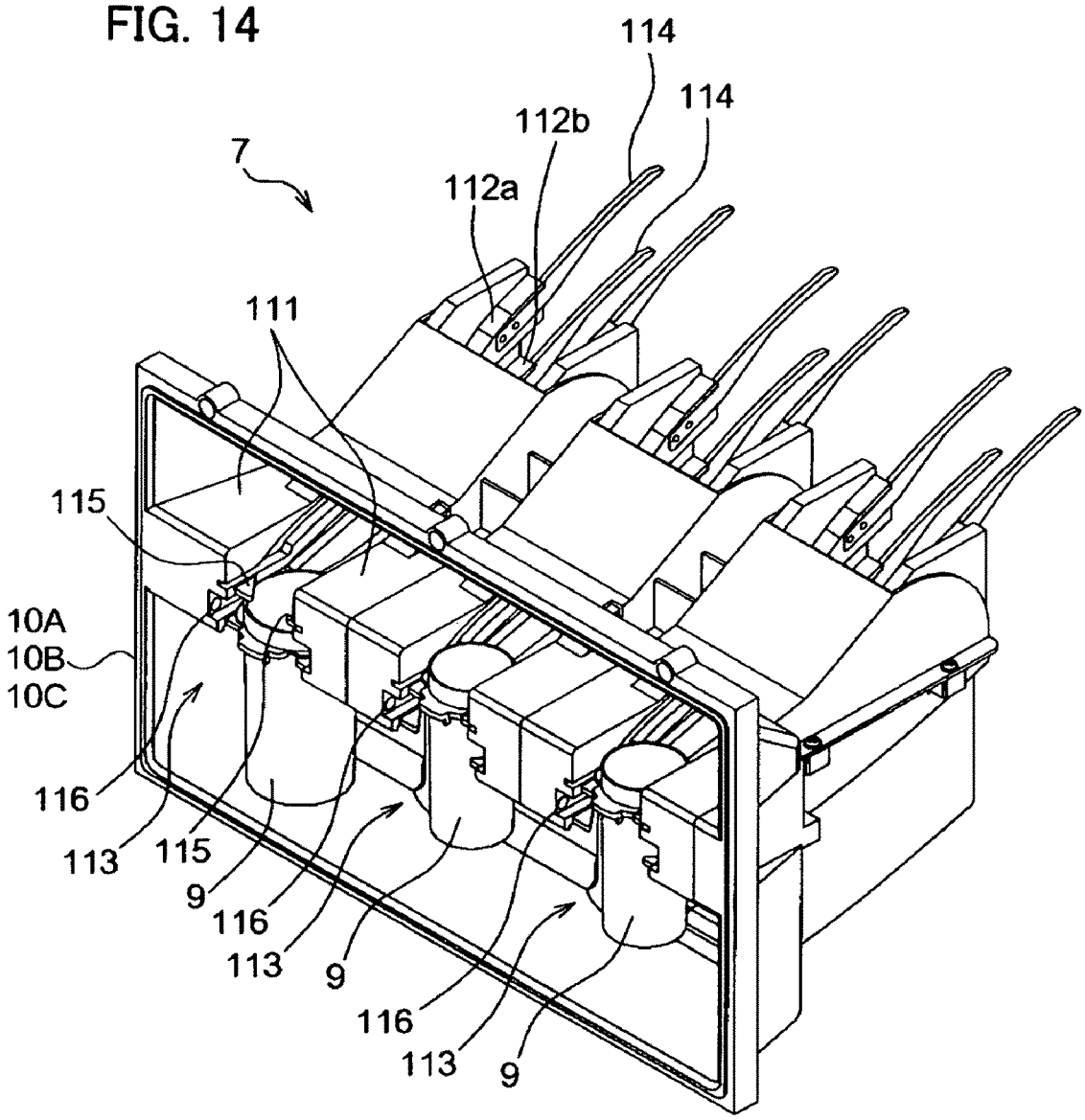
FIG. 14 is a perspective view of a discharging unit.

The arm unit 94, as shown in FIG. 13, mainly consists of (1) an orthogonal moving base 96 mounted on the second horizontal rail 93 so as to be moved by a motor 95, (2) a pivoting base 98 mounted on the orthogonal moving base 96 so as to be pivoted by a motor 97, and (3) a tilting base 99 mounted on the pivoting base 98 so as to be tilted by a motor not shown. The tilting base 99 is provided with a pair of arms 101 openable and closable by driving of a motor 100 so as to hold and release a vial 9. The pivoting base 98 is provided with a U-shaped sensor arm 102 and a driving arm 103 above the arms 101. The count sensors 104 are attached to both ends of the U-shape of the sensor arm 102 so as to count the number of tablets discharged from the tablet cassette 73. The driving arm 103 is provided with the driving shaft 106 rotating by being driven by the motor 105. The driving shaft 106 has at its end the engaging portion 107 engaging with the engaging receptacle 83 of the worm gear 82 of the above-mentioned tablet cassette 73. The driving arm 103 is further provided with the protruding piece 108 and the detection rod 109, the piece 108 positioning the arm unit 94 in the right place by engaging with the engaging portion 84 of the tablet cassette 73, and the rod 109 detecting whether the arm unit 94 is located in the right place.

<Discharging Unit 7>

The discharging unit 7 mainly consists of nine pairs of holding members 111, each three pairs of holding members 111 being disposed at each of the discharging windows 10A, 10B and 10C. The opposite sides of one pair of holding members 111 are each provided with two slopes 112*a* and 112*b* juxtaposed vertically, whose upper ends are located within the main body 8 and whose lower ends are located in any of the discharging windows 10A, 10B and 10C and form an outlet 113. A guiding member 114 extending obliquely upward is attached to the upper end of each of the slopes 112*a* and 112*b*. The guiding member 114 has a top face forming a slope continuous with the slope of the holding member 111. The slopes 112*a* and 112*b* have stoppers 115 attached to their lower ends respectively. The stoppers 115 normally project in a direction facing to each other by an urging force of a spring not shown, so as to catch a vial 9 having slid down the slopes 112*a* and 112*b*, while the stoppers 15 are withdrawn against the urging force of the spring when an operator takes out the vial 9, allowing the vial 9 to pass therethrough.

Figure 15:
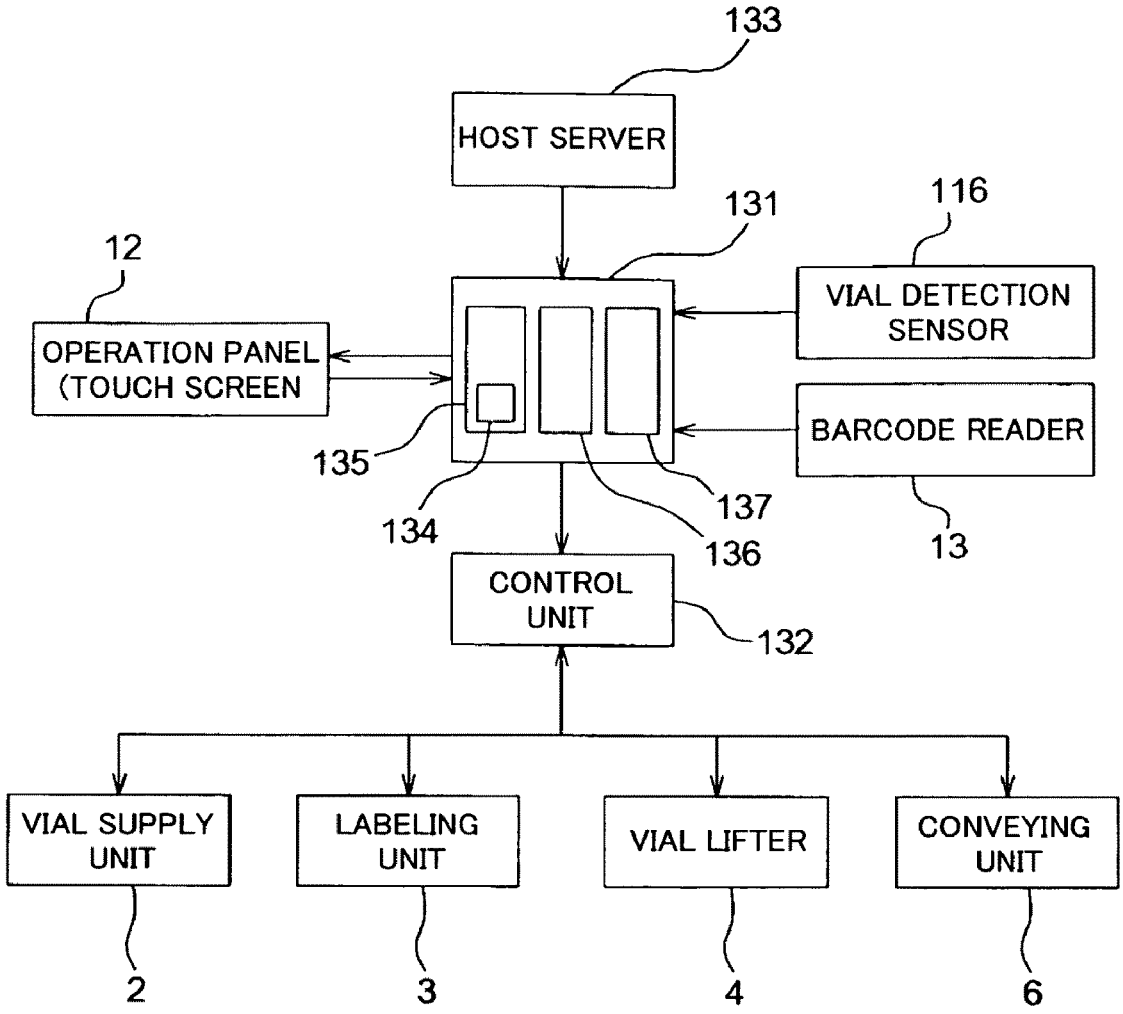
FIG. 15 is a block diagram of the tablet filling instrument.

FIG. 15 is a control block diagram of the tablet filling instrument 1 of the present invention. The vial supply unit 2, the labeling unit 3, the vial lifter 4, and the conveying unit 5 are controlled by a controlling unit 132 based on commands from a personal computer (PC) 131. The personal computer 131 is managed by a host server 133. The personal computer 131 receives signals inputted from a touch screen on the operation panel 12 and outputs display signals required for the operation panel 12. The personal computer 131 further receives read signals inputted from the barcode reader 13 and a vial detection sensor 116. The personal computer 131 mainly consists of a hard disk 135 including a drug master 134 and the like, a CPU 136, and a memory 137 for temporarily storing data such as prescription data and label image data.

Figure 16:
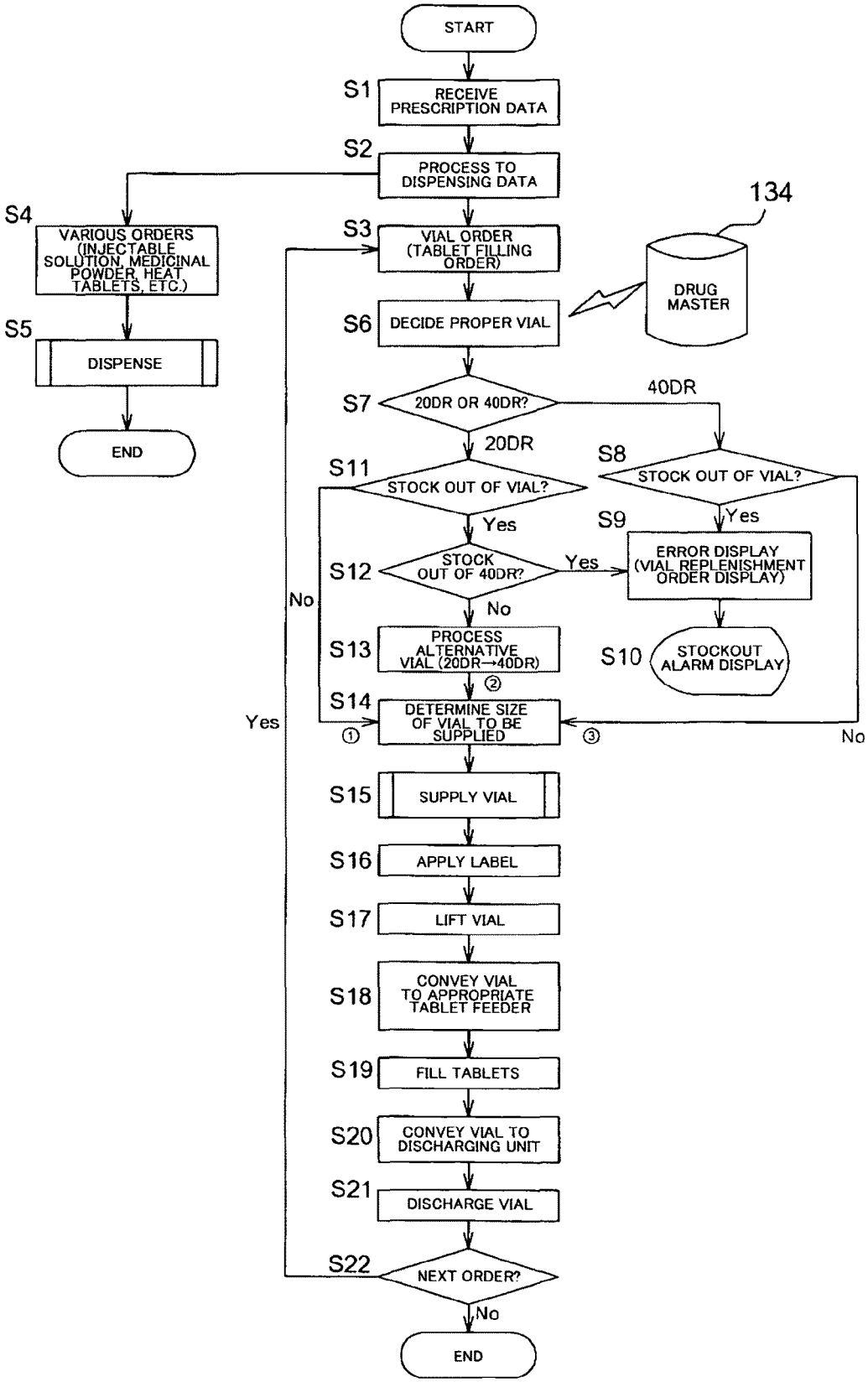
FIG. 16 is a flow chart showing operations of the tablet filling instrument.

Now, operations of the tablet filling instrument 1 having the above-mentioned configuration will be described below, with reference to the flow chart in FIG. 16.

A prescription data received from the host server 133 at step S1 is processed to a dispensing data at step S2. As to tablets, a vial order is submitted to the tablet filling instrument 1 at step S3. As to injectable solution, medicinal powder, heat tablets, and the like, a dispensing order is submitted to a respective instrument at step S4 to dispense them by the respective instrument or by hand at step S5. Upon reception of the vial order, the personal computer 131 selects a proper vial 9 having volume enough to be filled with tablets based on data of maximum filling volume from the drug master 134 at step S6. The drug master 134 stores therein the maximum filling volume in a vial 9 with respect to every tablet based on data such as shape, weight, and volume of the tablet.

At step S7, the vial 9 having been selected is detected whether it is of 20DR or 40DR. If the selected vial 9 is of 40DR, whether a vial 9 of 40DR is out of stock is detected based on a detection signal of the stockout sensor 29*a* of the stocker 21 at step S8. In the case that a vial 9 of 40DR is out of stock, a signal of error display (vial replenishment order display) is sent to the operation panel 12 at step S9. Thereby, at step S10, a stockout alarm display is indicated on the operation panel 12.

If the selected vial 9 is of 20DR at step S7, whether a vial 9 of 20DR is out of stock is detected based on a detection signal of the stockout sensor 29*a* of the stocker 21 at step S11. In the case that a vial 9 of 20DR is out of stock, whether an alternative vial 9 of 40DR larger than that of 20DR is out of stock is further detected at step S12. In the case of stockout, an error display is ordered at step S9, thereby indicating a stockout alarm display on the operation panel 12 at step S10. When an alternative vial 9 of 40DR is not out of stock at step S12, a size of the vial 9 having been selected in advance is altered from of 20DR to of 40DR at step S13. At step S14, when a vial 9 of 40DR is not out of stock at step S8, the size of a vial 9 is determined to be of 40DR as selected in advance. When a vial 9 of 20DR is not out of stock at step S11, the size of a vial 9 is determined to be of 20DR as selected in advance. When being altered at step S13, the size of a vial 9 is determined to be of alternative 40DR.

In this way, the size of a vial 9 is determined at step S14, supply operation of the vial 9 starts at step S16. First, the conveyor 23 and the take-out device 24 of the stocker 21 in which vials 9 of the determined size are contained are driven. Then, one of the vials 9 in the stocker 21 is taken out by means of the paddle 25 of the take-out device 24, sliding down the chute 27, and being placed on the forks 28. Herein, a gap of the forks 28 is adjusted in accordance with the size of the vial 9, thereby allowing the vial 9 to be held by the flange 9*a* in the forks 28 with its opening upward, even if the vial 9 slides down the chute 27 with either its top or bottom in the lead.

Upon completion of the vial supply operation, a labeling operation is done so as to apply a label 33 on the vial 9 at step S16. First, the pusher 32 is driven to move the vial 9 held in the forks 27 onto the holding plate 52 of the vial lifter 4. Then, while the vial 9 is pressed on the driving roller 38 of the label printer 31 and is rotated, the label printer 31 is operated. A prescribed data is printed on a label 33 of the label tape 34 passing through the print head 36, the printed label 33 being removed from the tape 34 on approaching the vial 9 and applied on the vial 9.

Upon completion of the labeling operation, a lifting operation of the vial 9 is done at step S17. When the lifting table 51 is moved up by means of the lifting mechanism 53, the pins 55 are inserted into the holding plate 52 and the bar 54 for opening and closing pins is disengaged from the movable blocks 56. Thereby, the pins 55 are moved by the urging force of the springs 58 to hold the vial 9. The lifting table 51 is further moved up, so as to push up the holding plate 52 hung up by the bracket 61, and stops on reaching a first delivery position of the conveying unit 6. Upon holding of the vial 9 by means of the conveying unit 6 at the first delivery position, the lifting table 51 is lowered. When the lifting table 51 comes near to a waiting position down below, the bar 54 is engaged with the movable blocks 56 to which the pins 55 are attached, thereby extending the space between the pins 55 against the urging force of the springs 58, and then the lifting table 51 waits so as to receive the next vial 9. The holding plate 52 gets hung up by the bracket 61 on the way down of the lifting table 51, so that only the lifting table 51 is lowered to the waiting position.

Upon completion of the delivery operation by lifting of the vial 9, the conveying unit 6 is driven at step S18, so as to convey the vial 9 to the tablet cassette 73 containing the appropriate tablets. First, the vertical rail 92 is moved in an anteroposterior direction along the first horizontal rails 91 and the second horizontal rail 93 is moved in a vertical direction along the vertical rail 92, and whereby the arm unit 94 on the second horizontal rail 93 is brought into closer to the vial 9 on the lifting table 51, so that the arms 101 of the arm unit 94 hold the vial 9. Then, the vial 9 held by the arm unit 94 is brought into closer to the tablet cassette 73 containing the appropriate tablets. Tilting of the tilting base 99 tilts the vial 9, which opening is made located obliquely below the tablet outlet 74. The arm unit 94 is proceeded, permitting the count sensor 104 to be inserted into the sensor hole 104' of the supporting panel 71, the detection rod 109 to be inserted into the detection rod hole 109' of the panel 71, and the protruding piece 108 to be inserted into the protruding piece hole 108' of the panel 71, so as to be engaged with the engaging portion 84 of the tablet cassette 73, and permitting the engaging portion 107 of the driving shaft 106 to be inserted into the driving shaft hole 106' of the panel 71, so as to be engaged with the engaging receptacle 83 of the tablet cassette 73.

Upon completion of conveyance of the vial 9, tablets are filled into the vial 9 at step S19. The motor 105 of the arm unit 94 is driven to rotate the rotor 77 of the tablet cassette 73 via the driving shaft 106, the worm gear 82, the intermediate gear 81, and the rotor gear 80. Thereby, tablets contained in the tablet container 76 and held in the pocket are dropped into the vial 9 one by one through the outlet 78 and the tablet outlet 74 of the supporting panel 71. The tablets passing through the tablet outlet 74 are each detected by the count sensor 104. Upon being filled with a predetermined number of tablets, the vial 9 is vertically held by returning the tilting base 99 horizontal.

Upon completion of filling of the tablets, at step S20, the conveying unit 6 is driven to convey the vial 9 having been filled with the tablets to the discharging unit 7. At this time, the vial 9 is arranged to be placed above the guiding members 114 of the holding members 111 of one of the outlets 113 in which the previously discharged vial 9 is not held. Herein, whether a vial is held or not in the outlet 113 is determined by an output signal from one of the vial detection sensors 116 disposed on a desired portion of the outlet 113, for example, on the side wall of the lower bottom of the slope 112*b*. Further, a vial 9 of a smaller size is arranged to be placed above the upper guiding members 114 and a vial 9 of a larger size is arranged to be placed above the lower guiding members 114.

Upon completion of conveyance of the vial 9, at step S21, the arms 101 of the arm unit 94 are opened to place the flange 9*a* of the vial 9 onto the guiding members 114 of the discharging unit 7. That allows the vial 9 to slide down the slopes 112*a* or 112*b* of a pair of the holding members 111 and to be held in the outlet 113. An operator can take out the vial 9.

Figure 17:
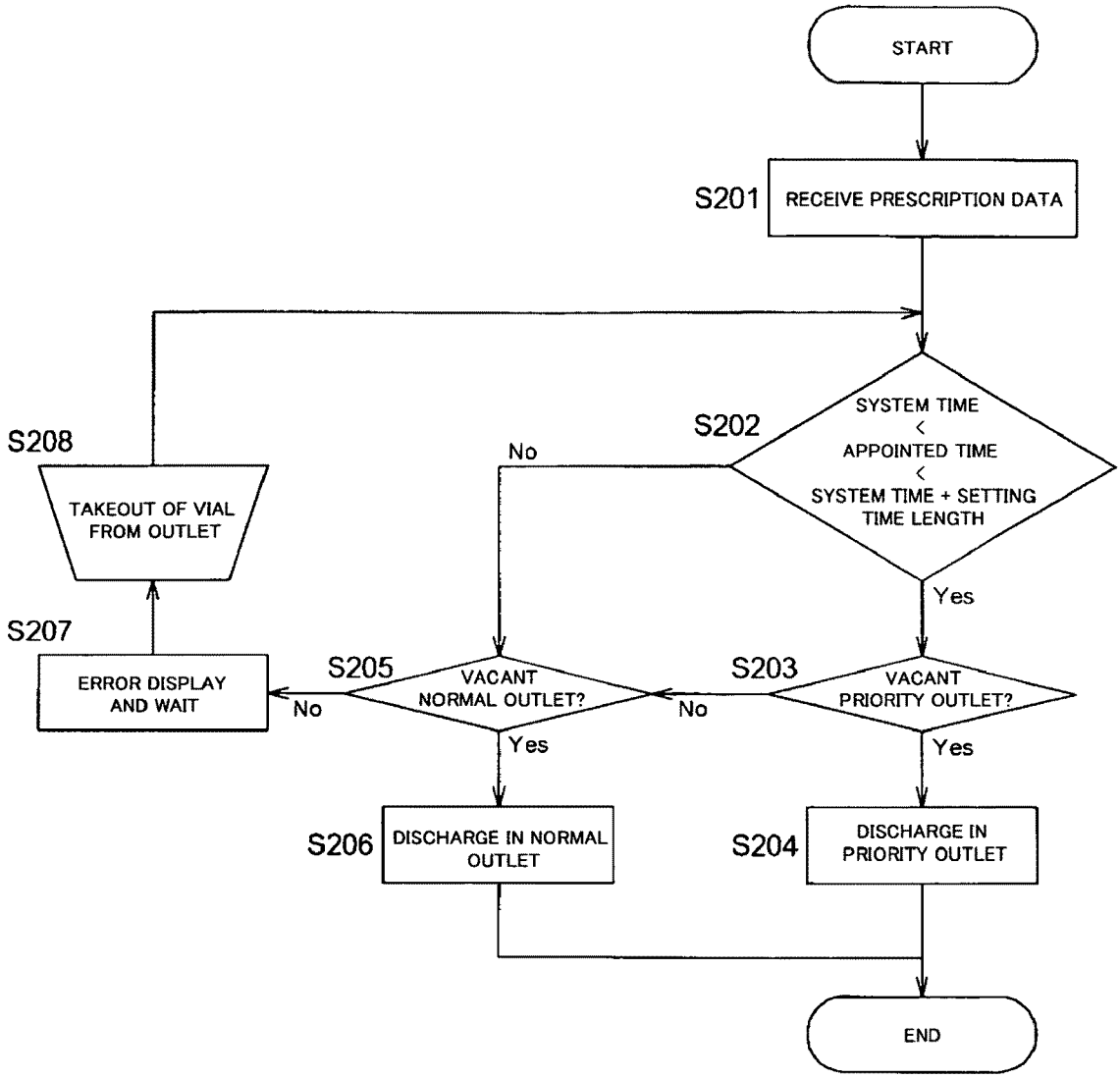
FIG. 17 is a flow chart showing operations of a priority discharging of a vial of the tablet filling instrument.
Figure 18:
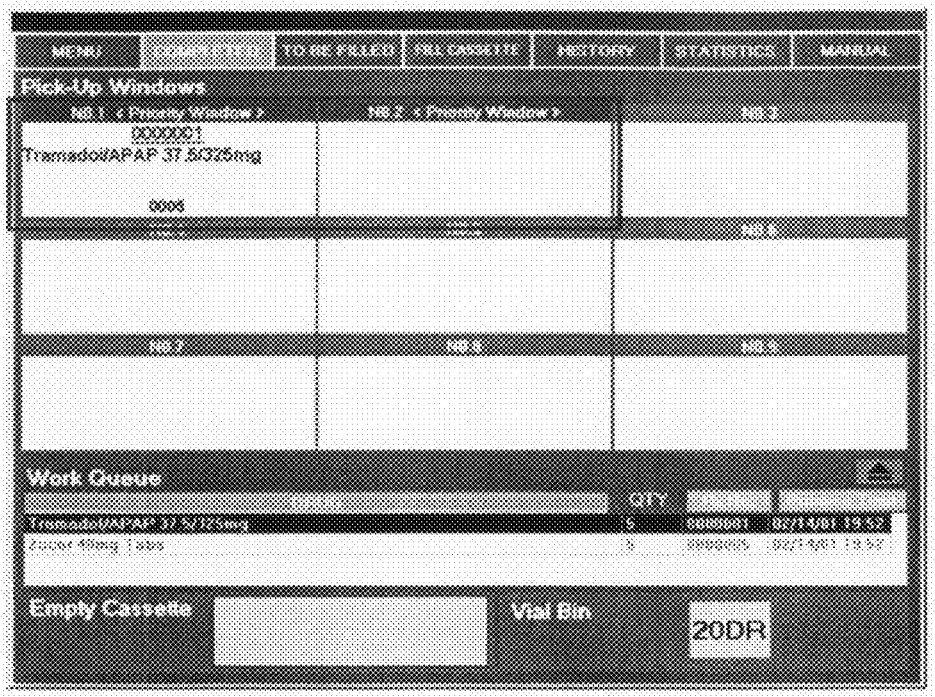
FIG. 18 is a front view of a screen indicating a layout of the outlets.

There are nine outlets 113 each having the respective pair of holding members, among which two outlets 113 from the left side on the upper level are designated as priority outlets $\mathbf{113}_p$ for discharging an urgent prescribed drug. On the operation panel 12 of the main body 8, as shown in FIG. 18, such a layout as the arrangement of the nine outlets 113 one through nine is displayed, the outlets 113 one and two being indicated to be the priority outlets $\mathbf{113}_p$. An operation of discharging of a vial 9 to the priority outlets $\mathbf{113}_p$ will be described in detail, with reference to a flow chart shown in FIG. 17.

A prescription data of a patient needing an urgent prescribed drug includes a time-point (appointed time-point or date and time) when the prepared drug is to be delivered. Upon reception of the prescription data at S201, whether the appointed time-point is between a present time-point (system time-point of a personal computer) and a set time-point (the present time-point plus a setting time length) is determined at step S202. The above-mentioned time-points are hereinafter abbreviated as the appointed time, the present time or the system time, and the set time, respectively. On the condition that the present time is at 9 a.m. on June $1^{st}$ and the set time is two hours later, that is, at 11 a.m. on June $1^{st}$, for instance, a prescription data having the appointed time at 10:30 a.m. on June $1^{st}$ is between the present time and the set time. That means the appointed time is quickly-impending, so that the vial needs to be discharged in either one of the priority outlet $\mathbf{113}_p$. By contrast, a prescription data having the appointed time at 1 p.m. on June $1^{st}$ has plenty of time before the appointed time, so that the vial should be discharged in the normal outlet 113.

By the determination at step S202, if the appointed time is between the present time and the set time, the appointed time is quickly-impending. Thus, whether there is a vacant priority outlet $\mathbf{113}_p$ is determined at step S203, and if there is, the vial 9 is discharged in the vacant outlet $\mathbf{113}_p$ at step S204. That facilitates an immediate takeout of the vial 9 having been discharged in the priority outlet $\mathbf{113}_p$. If there is no vacant priority outlet $\mathbf{113}_p$ by the determination at step S203, whether there is a vacant normal outlet 113 is further determined at step S205, and if there is, the vial 9 is discharged in the vacant normal outlet 113 at step S206. Herein, it is preferable to display that the vial 9 having been discharged in the normal outlet 113 has a priority over others. That urges to immediately take out the vial 9 having been discharged in the normal outlet 113.

By the determination at step S202, if the appointed time is not between the present time and the set time, there is plenty of time before the appointed time. Thus, whether there is a vacant normal outlet 113 is determined at step S205, and if there is, the vial 9 is discharged in the vacant normal outlet 113.

If there is no vacant normal outlet 113 by the determination at step S205, error display is indicated on the operation panel 12 at step S207, and then, a series of processes return to step S202, waiting until the vial 9 is taken out.

Figure 19:
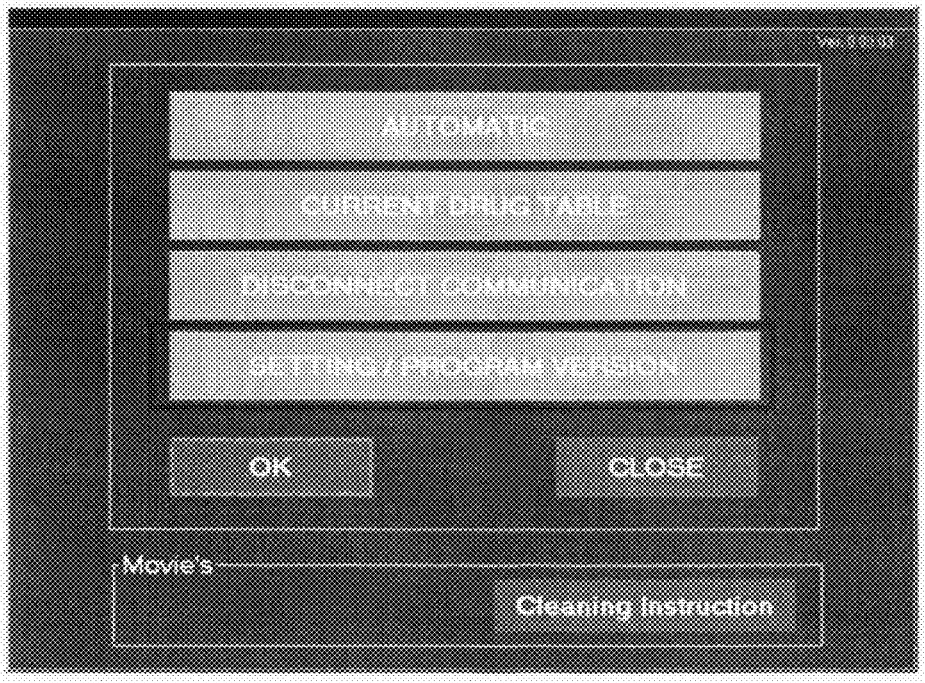
FIG. 19 is a front view of a screen of time setting.
Figure 20:
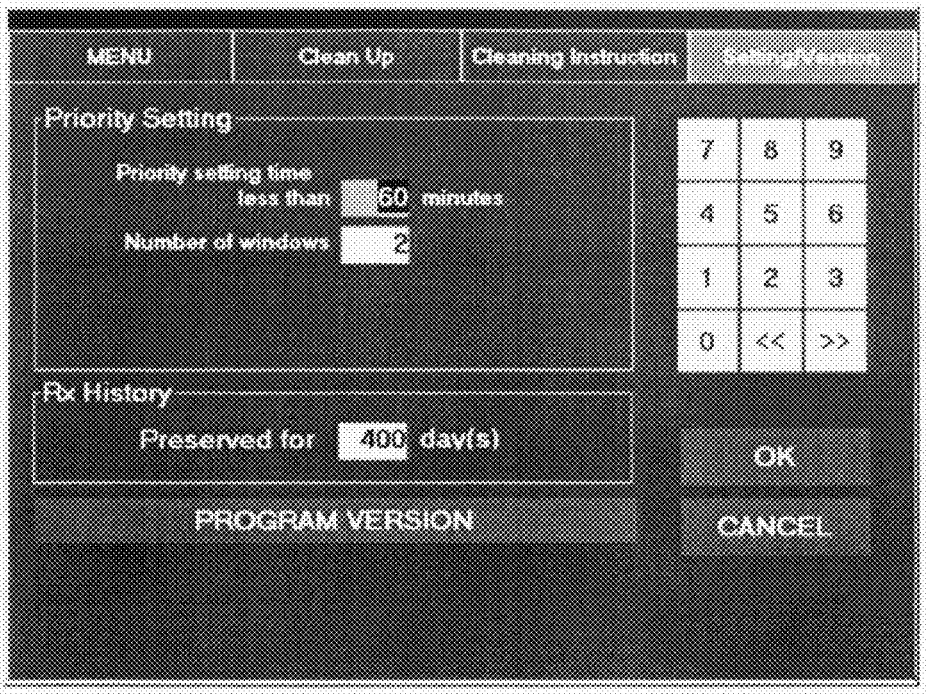
FIG. 20 is a front view of another screen of time setting.

The above-mentioned setting time length added to the system time is set on a screen of the operation panel 12. A screen shown in FIG. 20 pops up by pressing of "SETTING/PROGRAM VERSION" on a menu screen in FIG. 19. The screen indicates that a prescription having its appointed time set in less than 60 minutes from the system time is to be discharged in one of the two priority outlets $\mathbf{113}_p$. At this time, the setting time and the number of the priority outlet $\mathbf{113}_p$ can be altered.

The tablet filling instrument 1 of the present embodiment is provided with a label identification means described below, in order to identify drugs in a discharged vial without directly looking at a label applied on the vial. The label identification means includes (1) the memory 137 as a storing means for temporarily storing an image data of a label, on which a patient's name, a drug name, a direction for dosage, and etc. are printed, and which is applied on a vial by means of the labeling unit 3 based on a prescription data, (2) the vial detection sensors 116 each for detecting that a vial filled with drugs has been discharged in an outlet 113, (3) the operation panel 12 for indicating a layout display of discharging status of a vial and for selecting the displayed vial, and (4) the CPU 136 of the computer 131 as a controller.

Figure 21:
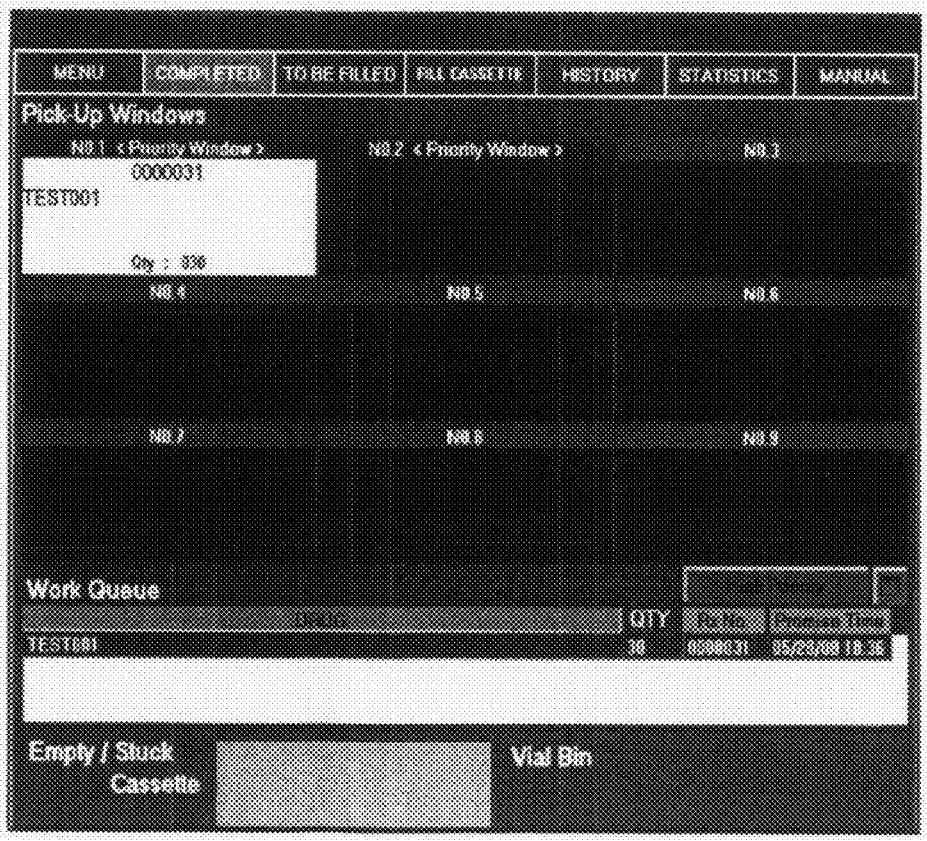
FIG. 21 is a front view of a screen showing an example of a title of a discharged vial.
Figure 22:
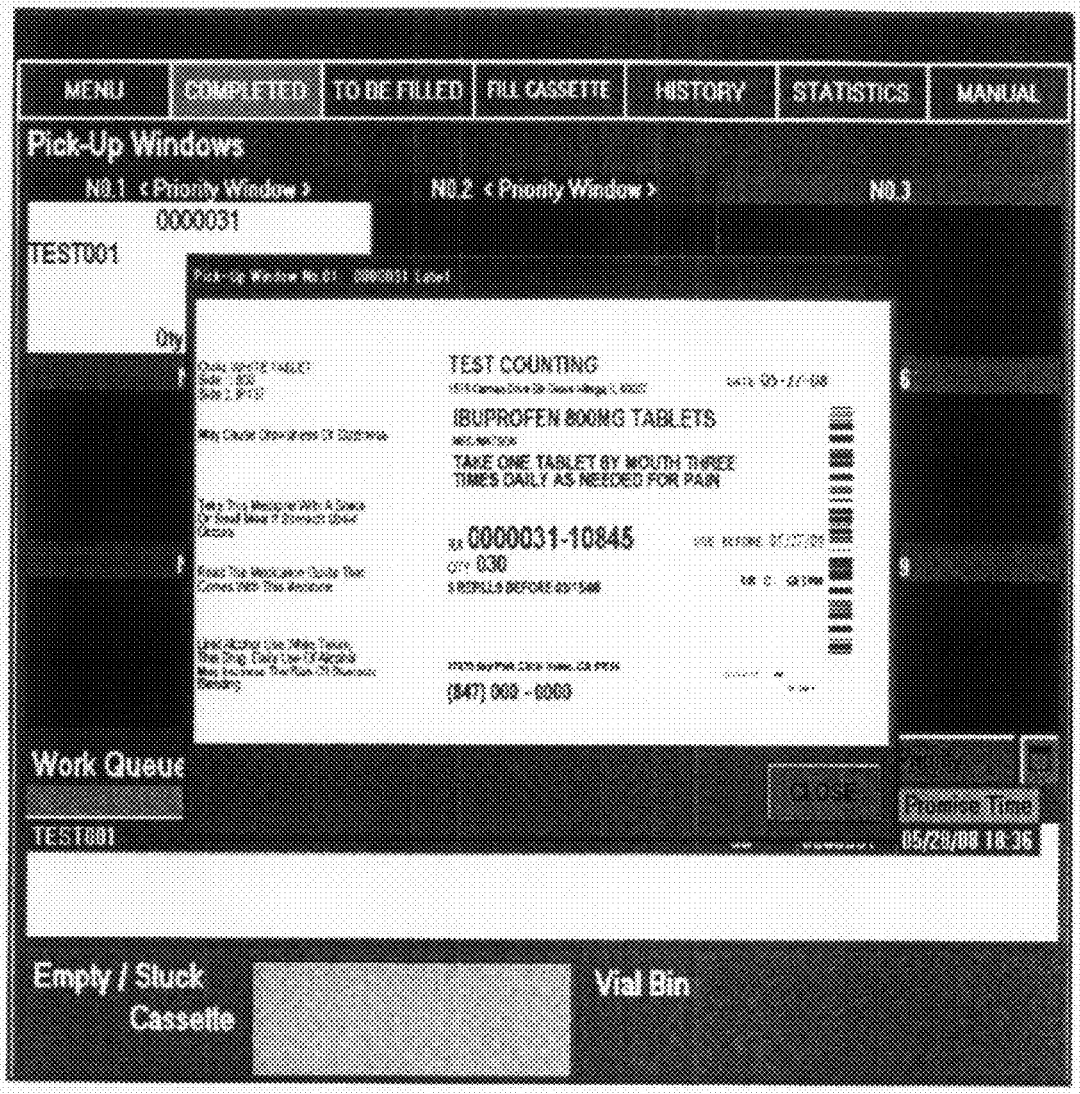
FIG. 22 is a front view of a screen showing an example of an image data of a label applied on a selected vial.

The CPU 136 of the computer 131 indicates a title of a discharged vial on the layout display of the operation panel 12, for example, as shown in FIG. 21, when a vial detection sensor 116 detects a vial 9 having been discharged in an outlet 113, so as to let a user know that the vial has been discharged. Herein, when the user pushes a displayed part (touch panel) indicating the discharged vial to select the vial, an image data of a label applied on the selected vial is called up from the memory 137, so as to be displayed on the operation panel 12 as shown in FIG. 22 for example. When the user takes out the vial having been discharged in the outlet 113 and the vial detection sensor 116 detects the takeout, the image data of the label of the vial stored in the memory 137 is erased.

Thereby, the user identifies the discharged drug without examining the label of the discharged vial with his or her own eyes. That achieves easy audit work. Further, though a label applied on a vial having a curved outer peripheral face is hard to be read, an image data displayed on the operation panel 12 is easy to be seen because of being plane and enlarged. That achieves rapid audit work. Still further, examination of both an image data on the operation panel 12 and a label applied on a vial ensures audit with an enhanced reliability as compared with the conventional audit work of a label by eyes. Yet further, since an image data of a label of a taken-out vial is erased in each case, a storage area in the memory 137 is saved, thereby avoiding lowered operation response.

The invention claimed is:

1. A tablet filling instrument comprising:

a vial supply unit;

a tablet supply unit;

a conveyor unit;

a discharging unit comprising a plurality of outlets including at least one designated priority outlet and a plurality of designated normal outlets; and a controlling unit, the controlling unit responsive to input commands based upon prescription data to cause coordinated operation of the vial supply, tablet supply, conveying and discharge units such that tablets from the tablet supply unit are delivered to vials from the vial supply unit and conveyed by the conveying unit to the discharging unit through which the vials are discharged to one of the outlets for dispensing, the controlling unit causing a prioritized vial with tablets that are designated to be dispensed at one of the outlets, at a time-point within a predetermined time length from a preset time-point, to be discharged by the discharging unit initially to the at least one designated priority outlet and not one of the designated normal outlets in the event that the at least one designated priority outlet is determined to be vacant.

2. The tablet filling instrument according to claim 1, wherein the time-point to dispense the tablets is contained in the prescription data.

3. The tablet filling instrument as defined in claim 1, wherein the controlling unit causes the prioritized vial with tablets to be discharged to one of the designated normal outlets in the event that it is determined that the at least one designated priority outlet is occupied.

4. The tablet filling instrument according to claim 3, wherein the time-point to dispense the tablets is contained in the prescription data.

5. The tablet filling instrument according to claim 3, wherein the tablet filling instrument further comprises a display upon which a user is alerted to a priority nature of the prioritized vial with tablets and urged to take the prioritized vial with tablets out of the one of the designated normal outlets.

6. The tablet filling instrument according to claim 5, wherein the time-point to dispense the tablets is contained in the prescription data.

* * * * *